US008956470B2

(12) United States Patent
Bhadeshia et al.

(10) Patent No.: US 8,956,470 B2
(45) Date of Patent: Feb. 17, 2015

(54) BAINITE STEEL AND METHODS OF MANUFACTURE THEREOF

(75) Inventors: Harshad Kumar Dharamshi Hansraj Bhadeshia, Cambridge (GB); Carlos Garcia-Mateo, Madrid (ES); Peter Brown, Salisbury (GB)

(73) Assignee: The Secretary of State for Defence in Her Britannic Majesty's Government of the United Kingdom of Great Britain and Northern Ireland, Salisbury, Wilshire (GB)

( * ) Notice: Subject to any disclaimer, the term of this patent is extended or adjusted under 35 U.S.C. 154(b) by 316 days.

(21) Appl. No.: 12/737,630

(22) PCT Filed: Jul. 31, 2009

(86) PCT No.: PCT/GB2009/050947

§ 371 (c)(1),
(2), (4) Date: Jan. 31, 2011

(87) PCT Pub. No.: WO2010/013054

PCT Pub. Date: Feb. 4, 2010

(65) Prior Publication Data

US 2011/0126946 A1 Jun. 2, 2011

(30) Foreign Application Priority Data

| | | |
|---|---|---|
| Jul. 31, 2008 | (GB) | 0814003.0 |
| Nov. 5, 2008 | (GB) | 0820184.0 |
| Nov. 5, 2008 | (GB) | 0820201.2 |
| Nov. 5, 2008 | (GB) | 0820212.9 |
| Dec. 18, 2008 | (GB) | 0822991.6 |

(51) Int. Cl.
*C22C 38/22* (2006.01)
*C21D 1/18* (2006.01)

(Continued)

(52) U.S. Cl.
CPC . *C22C 38/22* (2013.01); *C21D 1/18* (2013.01); *C21D 1/20* (2013.01); *C22C 38/04* (2013.01); *C22C 38/24* (2013.01); *C22C 38/34* (2013.01); *C21D 2211/002* (2013.01)
USPC ..... 148/335; 148/334; 420/104; 420/108

(58) Field of Classification Search
CPC ..... C22C 38/22
USPC ..... 148/333–335, 648, 654, 660; 420/99–101, 104–112
See application file for complete search history.

(56) References Cited

U.S. PATENT DOCUMENTS

| | | | | |
|---|---|---|---|---|
| 2005/0257860 | A1* | 11/2005 | Takayama | 148/572 |
| 2007/0163687 | A1 | 7/2007 | Kurosawa et al. | |
| 2011/0052442 | A1 | 3/2011 | Sherif | |

FOREIGN PATENT DOCUMENTS

| | | |
|---|---|---|
| EP | 0 003 208 | 7/1979 |
| GB | 2 352 726 | 2/2001 |

(Continued)

OTHER PUBLICATIONS

English language machine translation of JP 5-320749 to Tagashira translated Dec. 14, 2012.*

(Continued)

*Primary Examiner* — Brian Walck
(74) *Attorney, Agent, or Firm* — Nixon & Vanderhye P.C.

(57) ABSTRACT

A steel (known as super bainite steel) containing between 90% and 50% bainite, the rest being austenite, in which excess carbon remains within the bainitic ferrite at a concentration beyond that consistent with equilibrium; there is also partial partitioning of carbon into the residual austenite. In one embodiment of the disclosure, the steel contains in weight percent: carbon 0.6 to 1.1%, silicon 1.5 to 2.0%, manganese 0.5 to 1.8, nickel up to 3%, chromium 1.0 to 1.5, molybdenum 0.2 to 0.5%, vanadium 0.1 to 0.2%, balance iron save for incidental impurities. Excellent properties are obtained if the manganese content is about 1% by weight.

11 Claims, 3 Drawing Sheets

(51) Int. Cl.

| | |
|---|---|
| ***C21D 1/20*** | (2006.01) |
| ***C22C 38/04*** | (2006.01) |
| ***C22C 38/24*** | (2006.01) |
| ***C22C 38/34*** | (2006.01) |

(56) References Cited

FOREIGN PATENT DOCUMENTS

| | | |
|---|---|---|
| JP | 3-215623 | 9/1991 |
| JP | 4-59941 | 2/1992 |
| JP | 5-320749 | 12/1993 |
| JP | 6-033190 | 2/1994 |
| JP | 6-271930 | 9/1994 |
| WO | WO 01/11096 | 2/2001 |
| WO | WO 2009/118166 A1 | 10/2009 |

OTHER PUBLICATIONS

UK Search Report dated Oct. 26, 2009 for GB 0913382.8.
International Preliminary Report on Patentability and Written Opinion of the International Searching Authority dated Feb. 10, 2011 for PCT/GB2009/050947.
P.M. Brown et al, "Hyper-strength Bainitic steels" MS&T 2004 Conference Proceedings, Sep. 2004, pp. 433-438.
F.G. Caballero et al, "Design of novel high strength bainitic steels: Part 1" Materials Science and Technology, May 2001, vol. 17, 5 pages.
C. Garcia-Mateo et al, "Mechanical Properties of Low-Temperature Bainite" Materials Science Forum vols. 500-501, Nov. 2005, pp. 495-502.
Fielding "Literature Review The Bainite Controversy" Material Science and Technology (2013) vol. 29, No. 4 383-399.

* cited by examiner

BAINITE STEEL AND METHODS OF MANUFACTURE THEREOF

This application is the U.S. national phase of International Application No. PCT/GB2009/050947 filed 31 Jul. 2009, which designated the U.S. and claims priority to GB Application No. 0814003.0, filed 31 Jul. 2008; GB Application No. 0820184.0, filed 5 Nov. 2008; GB Application No. 0820201.2, filed 5 Nov. 2008; GB Application No. 0820212.9, filed 5 Nov. 2008; and GB Application No. 0822991.6, filed 18 Dec. 2008, the entire contents of each of which are hereby incorporated by reference.

This invention relates to bainite steel and methods of making the same. In particular it is related to, but not limited to steels suitable for armour. The invention also relates to transition microstructures which can later be processed into bainite steel.

A mainly bainitic steel is conventionally one having at least a 50% bainitic ferrite structure. Bainite is classified into two groups, upper and lower bainite.

Upper bainite is free of carbide precipitate within the bainitic ferrite grains but may have carbide precipitated at the boundaries.

Lower bainite has carbide precipitated inside the bainitic ferrite grains at a characteristic angle to the grain boundaries. There may also be carbides precipitated at the boundaries.

More recently carbide free bainite has been described in which comprises between 90% and 50% bainite, the rest being austenite, in which excess carbon remains within the bainitic ferrite at a concentration beyond that consistent with equilibrium; there is also partial partitioning of carbon into the residual austenite. Such bainite steel has very fine bainite platelets (thickness 100 nm or less). In this specification the expression "Super Bainite Steel" is used for such steel.

WO 01/011096 A (THE SECRETARY OF STATE FOR DEFENCE) 15/02/2001 describes and claims a mainly bainite steel. Although this material has low alloy costs compared to other known hard armour steels, manufacture involves heating for long periods, particularly in the transformation to bainite with resulting high energy costs and production timescales. This bainite steel is also very difficult to machine, drill or shape. As result its industrial usefulness is limited.

Japanese patent application JP05-320740A describes a lower bainite steel which is not carbide free.

The current invention provides a Super Bainite Steel which is comparatively economical to manufacture. Manufacturing processes are also described herein enabling easier machining, drilling and forming during the manufacturing process.

In the present invention a steel comprises between 90% and 50% bainite, the rest being austenite, in which excess carbon remains within the bainitic ferrite at a concentration beyond that consistent with equilibrium; there is also partial partitioning of carbon into the residual austenite with bainite platelets thickness 100 nm or less and comprising by weight per cent:

carbon 0.6% to 1.1%,
manganese 0.5to 1.8%,
nickel up to 3%,
chromium 0.5% to 1.5%,
molybdenum 0% to 0.5%,
vanadium 0% to 0.2%,
silicon about 0.5% to about 2% and
the balance iron save for incidental impurities.

Such steel can be very hard, 550HV to 750HV.

Silicon is preferred to aluminium both on cost grounds and for ease of manufacture, for armour steels aluminium would not, therefore, normally be used. The practical minimum silicon content is 0.5% by weight and it should not exceed 2% by weight. Excess silicon renders the process difficult to control.

Preferred ranges of some of the other constituents of the Super Bainite Steel, by weight percent, are:

manganese 0.5% to 1.5%;
chromium 1.0% to 1.5%;
molybdenum to 0.2% to 0.5%;
vanadium 0.1% to 0.2%.

The presence of molybdenum slows the pearlite transformation. It, therefore, makes the final transformation to bainite easier as the risk of transformation to pearlite is reduced. The presence of vanadium aids toughness.

By varying the manganese content, it has been found that rate of transition to bainite can be varied, the higher the manganese content the slower the transition. However, from a practical point of view it has been found that a manganese content of about 1% by weight percent provides a sensible compromise between speed of transition (and thus lower energy costs) and the ability to control the process. In reality, the manganese content, even if 1% by weight percent is aimed for, will vary between about 0.9% and 1.1% by weight percent, thus in this context of this invention, the word "about" implies a possible variation of + or −10% from the quoted figures.

Super Bainite Steels made with constituents within the preferred ranges have been found to have extremely fine bainite platelets (platelet thickness on average 40 nm or less thick and usually above 20 nm thick) and hardness of 630HV or greater.

The Super Bainite Steels described here are substantially free of blocky austenite.

In another aspect of the invention, a method of manufacture of Super Bainite Steel includes the steps of:

cooling a steel having a composition as characterised in the previous paragraphs sufficiently quickly to avoid the formation of pearlite from a temperature above its austenitic transition temperature to a temperature above its martensite start temperature but below the bainite start temperature;

holding the steel at a temperature within that range for up to a 1 week.

Additional steps may be included:

initially cooling a steel having a composition as characterised in the previous paragraphs into a fully pearlite state;

reheating the steel to a fully austenitic state;

The steel is then cooled and transformed as described in the previous paragraph.

The martensite start temperature varies considerably depending on the exact alloy composition. Illustrative examples for several compositions are shown in the Figures described below. For practical purposes the transformation temperature would be above 190° C. to ensure that transformation took place reasonably quickly.

Additional steps may be included:

reheating the steel in its pearlite form to austenitise it, and allowing the steel to cool again sufficiently slowly into a fully pearlite phase.

This step can be repeated.

Another possible step is to anneal the steel in its pearlite form. This is best done as the step prior to the final austenitisation and subsequent transformation steps.

Normally, in practice, when pearlite formation steps are carried out the steel will be allowed to reach ambient temperature.

It is a feature of the process described in the preceding paragraphs that as pearlite, the steel can be machined, drilled and formed with relative ease. In its pearlite form the steel alloy is a useful commercial product that can be sold in its own right. It can be cut, machined, drilled or formed prior to sale with the purchaser having only to carry out the final austenitising and transformation steps, or the producer could carry out the machining, drilling or forming, with the purchasers left to undertake the final steps to transform the steel to Super Bainite Steel.

The steel may be hot rolled whilst in an austenite phase.

Normally rolled steel made in this way will be cut into lengths prior to transformation to Super Bainite Steel It has been found that the transformation to Super Bainite Steel best takes place between 8 hours and 3 days, although most economically in about 8 hours. A good compromise between economic manufacture and hardness is obtained if the transformation step is within the temperature range 220° C. to 260° C. and ideally at 250° C.

If the steel is in thick plates, (above 8 mm thick), temperature distribution within the steel when it reaches the bainite transformation temperature may not be uniform. The temperature at the centre of the plate, in particular, may remain above the desired transformation temperature with the result that uneven transformation properties are obtained. To overcome this, the steel concerned is cooled from its austenitisation temperature to a temperature just above the temperature at which transformation to bainite will start and held above that temperature until the steel is substantially uniform in temperature, before recommencing cooling into the bainite transformation temperature range.

It will be noted that Super Bainite Steel according to the invention involve transformation step timescales that are much shorter than those described in WO01/011096, with significant reductions in the energy consumed.

Where Super Bainite Steel is manufactured as described above and the transformation temperature does not exceed 250° C., the resulting Super Bainite Steel has between 60% and 80% by volume of a bainitic ferrite with excess carbon in solution. The remainder is substantially a carbon-enriched austenite phase steel. The Super Bainite Steel thus made is very hard, has high ballistic resistance and is particularly suitable as armour steel. The Super Bainite Steel has no blocking austenite.

Comparative tests of different bainite steels were carried out. The compositions of the steels used for illustrative purposes are given Table 1 (attached).

Examples 1 and 2 are of steel prepared in accordance with WO 01/011096. Example 3 is of steel in accordance with this invention. The alloys were prepared as 50 kg vacuum induction melted ingots (150×150×450 mm) using high purity raw materials. After casting ingots were homogenised at 1200° C. for 48 hours, furnace cooled, cropped and cut in to 150 mm thick square blocks. These were subsequently reduced to a thickness of 60 mm by hot forging at 1000° C. and immediately hot rolled at the same temperature to produce 500×200 mm plates with a thickness of 25 mm. All plates were furnace cooled from 1000° C. In this condition plates exhibited a hardness of 450-550 HV.

Plates were softened at 650° C. for 24 hours and furnace cooled to reduce their hardness to below 300HV. This allowed test materials to be prepared using conventional machining operations thus avoiding the need to employ specialised techniques required for high hardness steels.

Several 10 mm cubes of material were removed from the central region of each plate. These samples were austenitised at 1000° C. for 1 hour and then bainite transformation heat treated at 200-250° C. in an air recirculation oven for up to 400 hours before being air cooled. Samples were cut in half, mounted, ground, polished to a 1 micrometer finish and hardness tested. Hardness was determined with a Vickers hardness tester using a pyramidal indenter and a 30 kg load. Ten indents were made in the central region of each sample with the mean hardness value being taken as indicative.

Specimen blanks were removed from each softened plate, austenitised at 1000° C. and hardened at 200-250° C. for various times by which, based on the above hardness trials, the transformation of austenite to bainite was considered to have terminated. Tensile testing was conducted in accordance with the relevant British Standard using 5 mm diameter specimens. Compression testing was carried out using 6 mm diameter specimens with a height of 6 mm at a strain rate of $10^{-3}$ $s^{-1}$. Impact testing with standard V-notch Charpy specimens was performed on a 300 J Charpy testing machine. All tests were conducted at room temperature with impact and tensile results being presented as the average of three tests.

The variation of hardness with transformation temperature was measured. Example 1 exhibited pronounced hardening. A minimum hardness of 600 HV was observed after 110 hours at 200° C. which is consistent with the onset of the bainite transformation determined by X-ray experiments. Hardness values subsequently rose to 640HV after a further 100 hours, marking the end of bainite formation, and slowly increased to 660HV after a total of 400 hours.

Although an increase in transformation temperature to either 225° C. or 250° C. reduced bainite transformation times in Example 1 to 100 hours and 50 hours respectively, this was accompanied by a decline in the hardness observed.

Example 2 was similar to Example 1 but had additions of cobalt and aluminium; it also exhibited pronounced hardening. The time required to achieve a hardness of 650HV at 200° C. was reduced from 400 hours to 200 hours. Higher temperatures were again associated with shorter transformation times with a hardness of 575HV being achieved after 24 hours at 250° C. as opposed to 48 hours in Example 1. Although using cobalt and aluminium was successful in reducing heat treatment times, the high price of both cobalt and aluminium together with the difficulty of processing steel alloys including aluminium make Example 2 commercially unattractive.

Example 3, the Super Bainite Steel that is the subject of this invention, exhibited a higher hardness than Examples 1 or 2. A hardness of 690HV was achieved after 24 hours at 200° C. compared to 650-660HV in Examples 1 and 2 after 200-400 hours. At a transformation temperature of 250° C. a hardness of 630HV was recorded after only 8 hours whereas Examples 1 and 2 failed to reach 600HV even after several hundred hours.

The tensile properties of Example 1, 2 and 3 after hardening at 200-250° C. for various times associated with the end of bainite transformation are shown in Table 2 (attached). This shows that the proof strength of each alloy gently declined with increasing transformation temperature. A similar decline in tensile strength was also observed, with the exception of the Example 3 transformed for 8 hours at 250° C. However, the tensile ductility of alloys transformed at 250° C. was 2 to 3 times greater than that of material heat treated at 200° C.

Testing illustrated that materials transformed at 200° C. exhibited the highest levels of hardness. Transformation to Super Bainite steel at 250° C. may be appropriate in practice as this facilitates quicker formation of more ductile material without incurring significant reductions in strength. The benefits of this approach are most visible in Example 3C, the subject of this invention, treated at 250° C. which, because of its increased ductility, was able to work harden to a tensile strength of 2098 MPa, i.e. the highest tensile strength of all the alloys studied.

The impact properties of Examples 1, 2 and 3 showed that all exhibited low values of room temperature Charpy impact energy which varied between 4-7 Joules.

It is the ability of materials made using the method of the invention to form a high volume fraction of ultra-fine, interstitially hardened bainite steel which allows them to exhibit strength levels comparable to those of the stronger maraging steels, with relatively low consumptions of energy. Furthermore, unlike maraging steels (<75% Fe), materials of the invention are able to do this without using high levels of expensive alloying elements.

The invention will be further illustrated with reference to the accompanying drawings in which.

Figure 1A:
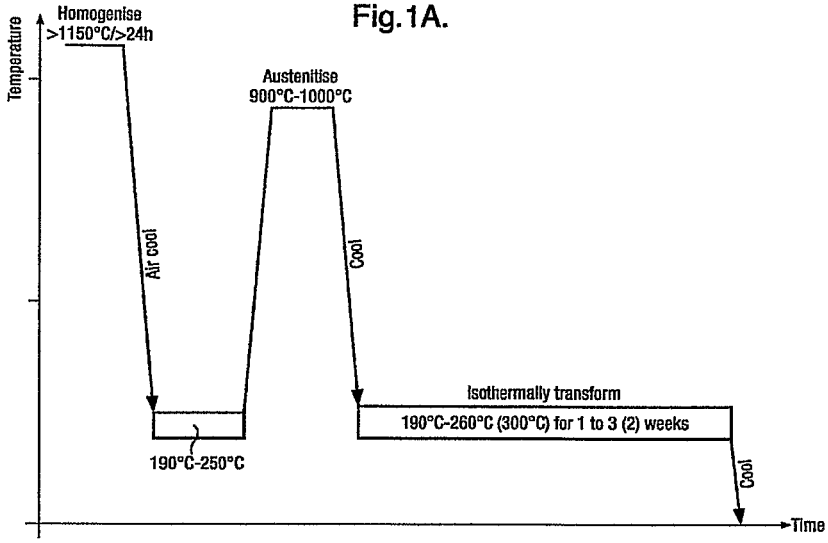
FIG. 1A shows the manufacturing process described in PCT patent application WO2001/11096.

In FIG. 1A, the material is homogenized at more than 1150° C. and air cooled to a temperature of between 190 and 250° C. The sample illustrated must be a small one having a high surface area. The sample is then reheated to austenitise it at a temperature of 900 to 1000° C. This can be achieved in about 30 minutes. It is then furnace cooled to a temperature of 190 to 260° C. and held at that temperature for a period of one to three weeks, although if held at a temperature of 300° C., the maximum time is reduced to two weeks.

Figure 1B:
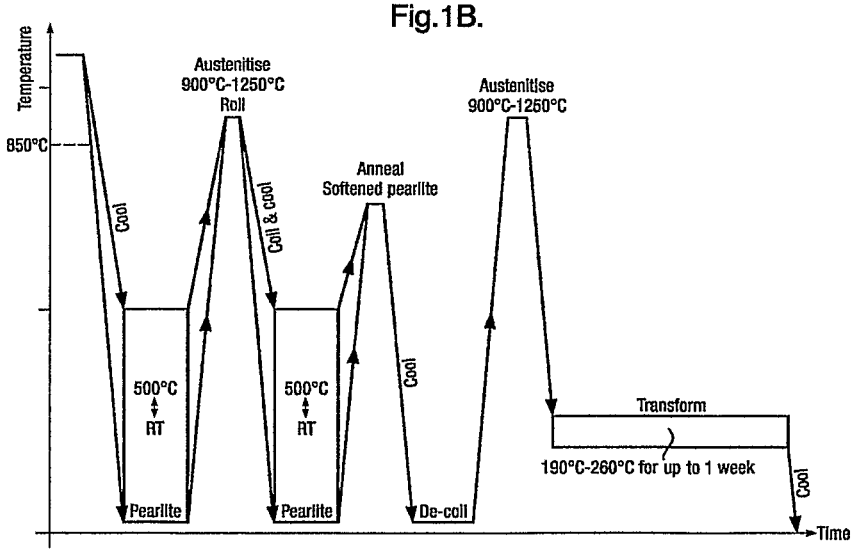
FIG. 1B shows a manufacturing process used in conjunction with the present invention.

FIG. 1B illustrates a manufacturing process for a material of the present invention that will transform to pearlite with a relatively slow cooling process of about 2° C./minute. However, this is not considered to be a slow process, and one easily achieved economically in a steel mill. Typically, in the production process the steel is allowed to cool from a high temperature (above its austenite transition temperature) as large thick plates, often in stacks. The cooling rate is naturally about 2° C./minute, which is sufficiently slow to enable a fully pearlite phase to form. The plates are then heated again to above 850° C. to austenitise them. The hot material is passed through rolling mills to form strip steel, in this example, 6 to 8 mm thick and coiled. Obviously the thickness can be greater or less than the range given to suit the customer's requirement. The thermal capacity of the coil restricts the cooling rate sufficiently to ensure that pearlite is again formed as the material cools to ambient (room in this case) temperature (RT). This is conveniently achieved by allowing the coiled steel to cool in air naturally over 48 hours, for example. At this stage the coils can be de-coiled and cut into plates or reheated to anneal it and before allowing it to cool to ambient temperature. Once back to ambient temperature, room temperature in this example, (RT in FIG. 1B), it can be cut and machined, drilled and shaped, before undergoing the final austenisation and the bainite transformation step. At this stage it is in individual pieces and cools after this austenitisation much more rapidly thus avoiding passing through the pearlite phase. Once it has reached a temperature of 190° C. to 260° C., it is held at that temperature to allow the bainite transformation step to be completed. The exact bainite transformation period required depends on the manganese content of the steel, the lower the manganese content the shorter the transformation time required. A preferred material containing about 1% manganese can be transformed in 8 hours.

Figure 1C:
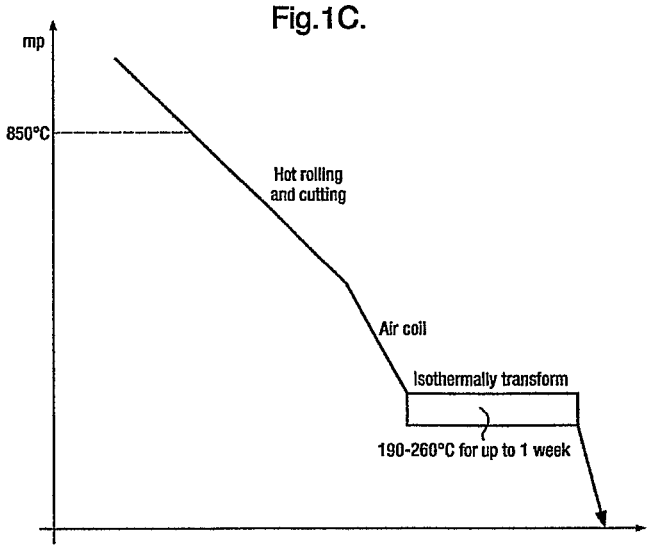
FIG. 1C shows an alternative manufacturing process used in conjunction with the present invention.

In FIG. 1C, the steel is hot rolled whilst in an austenitic phase, either immediately after casting from a hot melt or possibly after heating into the austenite phase for homogenisation or deformation. The steel can then be cut into plates. The plates can be air cooled. The rate of cooling is such that the plates will reach the transformation temperature at an appropriate point to allow transformation to Super Bainite Steel to occur. This can take place in a temperature controlled air recirculation furnace of other suitable environment.

Figure 2:
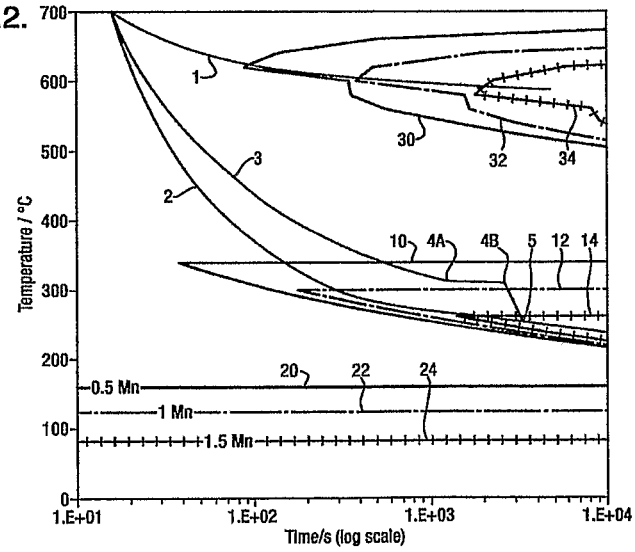
FIG. 2 shows a temperature/time/transformation diagram for a preferred steel according to the invention showing the impact of varying the manganese content; it should be noted that precise diagrams will vary according to the composition of the steel.

The temperature/time/transformation diagram for Super Bainite steels according to the invention showing the effect of varying the manganese content is shown in FIG. 2.

The final transformation from austenite to bainite is shown for thin plate (typically 6 to 8 mm) thick by curve 2. Here individual plates are air cooled, by separation of the plates; the cooling rate is typically 80° C./min for example. This avoids transformation to pearlite. If necessary the cooling rate should be controlled accordingly. The bainite transition for 0.5% by weight manganese is shown by the line 10, for 1.0% by weight manganese by line 12, and for 1.5% by weight manganese by line 14. Quenching will convert the material to martensite, the martensite start temperatures are shown by lines 20, 22 and 24 for 0.5%, 1.0% and 1.5% by weight manganese respectively. Failure to maintain the transformation temperature within the range indicates by curves 10, 12 or 14 as appropriate for adequate periods may risk partial transformation to martensite. The curves 30 (for 0.5% by weight manganese), 32 (for 1% by weight manganese) and 34 (for 1.5% by weight manganese) indicate transformation to pearlite which is to be avoided in the final transformation stage of the process. The bainite start temperature is the temperature above which bainite will not from. In FIG. 2, for bainite curves, 10, 12 and 14 the bainite start temperature is represented by the flat uppermost portions of each curve.

As the thickness of the plate increases, the greater the chance of the slower cooling at the centre of the plate allowing a partial pearlite phase to form at the centre and a less homogeneous structure is obtained. This can be avoided by following a cooling curve such as that marked 3, which is for a 1% by weight manganese steel in accordance with invention. In this case the temperature is reduced to one marked 4A just above the bainite transition start temperature 12 and held just above that transition temperature until the temperature within the plate is uniform. At that point (4B) the temperature is reduced to a point 5 within the transformation range and held within that range to allow the transformation to bainite to take place.

Figure 3:
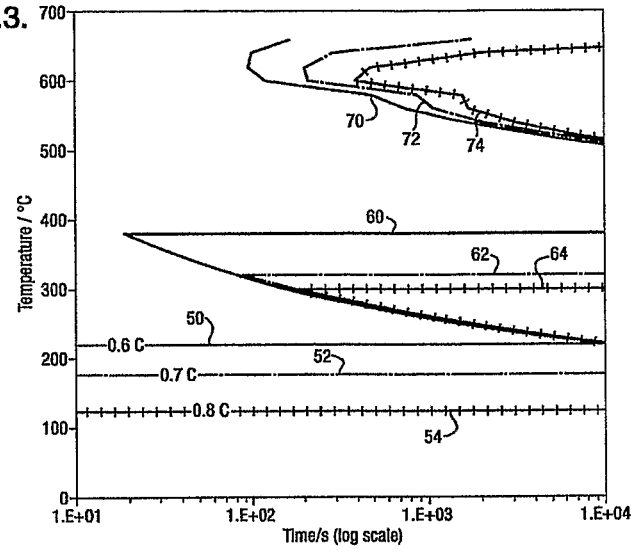
FIG. 3 shows a temperature/time/transformation diagram for a preferred steel according to the invention having 1% manganese showing the impact of varying the carbon content; it should be noted that precise diagrams will vary according to the exact composition of the steel.
Figure 4:
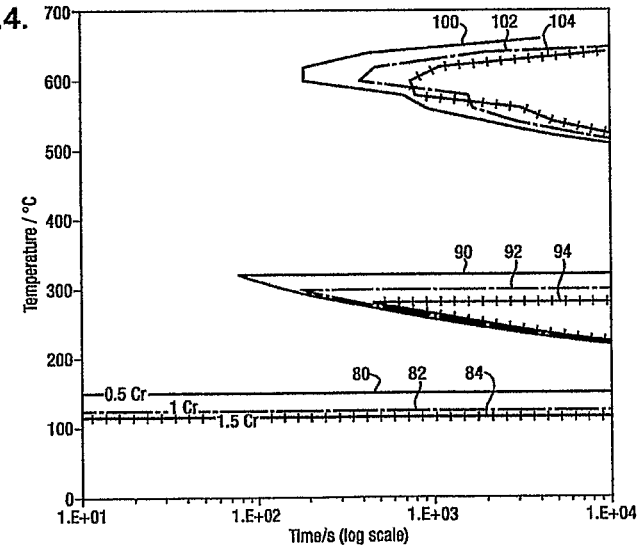
FIG. 4 shows a temperature/time/transformation diagram for a preferred steel according to the invention having 1% manganese showing the impact of varying the chromium content. It should be noted that precise diagrams will vary according to the exact composition of the steel.

In FIG. 3 the bainite temperature/time/transition curves for 0.6% by weight carbon is shown by the line 60, for 0.7% by weight carbon by line 62, and for 0.8% by weight carbon by line 64. Quenching will convert the material to martensite. The transition temperatures are shown by lines 50, 52 and 54 for 0.6%, 0.7% and 0.8% by weight carbon respectively. Similarly failure to maintain the transformation temperature within the range indicated by curves 60, 62, or 64 as appropriate for adequate periods will risk partial transformation to martensite. Curves 70, 72 and 74 show the pearlite transitions for carbon contents of 0.6%, 0.7% and 0.8% by weight respectively. The bainite start temperature is the temperature above bainite will not from. In FIG. 3, for bainite curves, 60, 62 and 64 the bainite start temperature is represented by the flat uppermost portions of each curve, FIG. 4 similarly shows the bainite temperature/time/transition curves for 0.5% by weight chromium (line 90), for 1.0% by weight chromium (line 92), and 1.5% by weight chromium (line 94). Quenching will convert the material to martensite the transition temperatures are shown by lines 80, 82 and 94 for 0.5%, 1.0% and 1.5 by weight chromium respectively. Failure to maintain the transformation temperature within the range indicates by curves 90, 92, or 94 as appropriate for adequate periods will risk partial transformation to martensite. Curves 100, 102 and 104 show the pearlite transitions for chromium contents of 0.5%, 1.0% and 1.5% by weight respectively. The bainite start temperature is the temperature above bainite will not from. In FIG. 4, for bainite curves, 90, 92 and 94 the bainite start temperature is represented by the flat uppermost portions of each curve.

TABLE 1

Composition of Examples 1, 2 and 3 (by weight %)

| Alloy | C | Si | Mn | Cr | Mo | Al | Co | V | P | S | Fe |
|---|---|---|---|---|---|---|---|---|---|---|---|
| Example 1 | 0.60 | 1.60 | 1.99 | 1.29 | 0.25 | — | — | 0.1 | <.005 | <.01 | ~94 |
| Example 2 | 0.82 | 1.55 | 2.01 | 1.01 | 0.25 | 1.03 | 1.51 | 0.1 | <.005 | <.01 | ~92 |
| Example 3 | 0.79 | 1.55 | 1.00 | 1.01 | 0.25 | | | 0.1 | <.005 | <.01 | ~94.5 |

TABLE 2

Mechanical properties of Examples 1, 2 and 3

| Example | Balnite Transformation Temperature ° C./ Time (hours) | 0.2 PS Mpa ($Rp_{0.2}$) | UTS Mpa ($R_m$) | El % (A) | RA % (Z) | Hardness HV30 (Hv30) | Charpy J (measured at room temperature) |
|---|---|---|---|---|---|---|---|
| 1A | 200/400 | 1684 | 2003 | 3.1 | 4 | 650 | 4 |
| 1B | 225/100 | 1669 | 2048 | 4.3 | 4 | 620 | 4 |
| 1C | 250/50 | 1525 | 1926 | 8.8 | 6 | 590 | 6 |
| 2A | 200/200 | 1588 | 2096 | 3.3 | 4 | 650 | 4 |
| 2B | 225/70 | 1625 | 2072 | 6.5 | 5 | 620 | 5 |
| 2C | 250/24 | 1531 | 1933 | 11.3 | 7 | 590 | 7 |
| 3A | 200/24 | 1678 | 1981 | 4.3 | 5 | 690 | 5 |
| 3C | 250/8 | 1673 | 2098 | 8.0 | 5 | 640 | 5 |

In the table:
PS IS Proof Stress;
UTS is Ultimate Tensile Strength
El is Elongation
RA is Reduction of Area
HV is Vickers Hardness The Charpy number is based on a 10 mm×10 mm specimen (care needs to be taken In comparison of the Charpy number as 10 mm×10 mm usually used figures using 5 mm×5 mm specimen are quoted In some papers.)

In Table 2 examples, the suffix letters relate to different specimens of Examples 1, 2 and 3 subjected to the different transformation temperatures indicated.

The invention claimed is:

1. Steel comprising between 90% and 50% bainite, the rest being austenite, in which excess carbon remains within the bainitic ferrite at a concentration beyond that consistent with equilibrium; there is also partial partitioning of carbon into the residual austenite with bainite platelets thickness 100 nm or less and by weight percent: carbon 0.6% to 1.1% , manganese 0.5 to 1.8% , nickel up to 3% , chromium 0.5% to 1.5% , molybdenum 0% to 0.5%, vanadium 0% to 0.2% , silicon about 0.5% to about 2% and the balance iron save for incidental impurities.

2. Steel comprising between 90% and 50% bainite, the rest being austenite, in which excess carbon remains within the bainitic ferrite at a concentration beyond that consistent with equilibrium; there is also partial partitioning of carbon into the residual austenite with bainite platelets thickness 100 nm or less and by weight percent: carbon 0.6% to 1.1 %, manganese 0.5% to 1.5% , nickel up to 3% , chromium 1.0% to 1.5 %, molybdenum 0.2% to 0.5% , vanadium 0.1% to 0.2% , silicon 0.5% to 2% , and the balance iron save for incidental impurities.

3. Steel according to claim 1 characterised in that the manganese content is in range of about 0.5% by weight to 1.5% by weight.

4. Steel according to claim 3 characterised in that the manganese content is about 1% by weight.

5. Steel according to claim 1 or claim 2 having an average bainite platelet thickness below 40 nm.

6. A plate formed from a steel of claim 1.

7. The plate of claim 6, wherein the plate has been the subject of mechanical working.

8. The plate of claim 6, wherein the plate has been the subject of mechanical working selected from the group comprising cutting, machining, drilling, or shaping.

9. A plate formed from a steel comprising between 90% and 50% bainite, the rest being austenite, in which excess carbon remains within the bainitic ferrite at a concentration beyond that consistent with equilibrium; there is also partial partitioning of carbon into the residual austenite with bainite platelets thickness 100 nm or less and by weight percent: carbon 0.6% to 1.1% , manganese 0.5% to 1.5% , nickel up to 3% , chromium 1.0% to 1.5% , molybdenum 0.2% to 0.5% , vanadium 0.1% to 0.2% , silicon 0.5% to 2% , and the balance iron save for incidental impurities.

10. The plate of claim 9, wherein the plate has been the subject of mechanical working.

11. The plate of claim 10, wherein the plate has been the subject of mechanical working selected from the group comprising cutting, machining, drilling, or shaping.

* * * * *